United States Patent [19]

Jones et al.

[11] 4,438,596

[45] Mar. 27, 1984

[54] REMOVABLE BARRIER ASSEMBLY

[76] Inventors: Johnnie Jones, 4066 Ranchero Dr., Dorr, Mich. 49323; Joseph A. Einig, 2215 108th St., Byron Center, Mich. 49315; Arthur T. Ackerson, 3879 40th St., Grandville, Mich. 49418

[21] Appl. No.: 351,318

[22] Filed: Feb. 22, 1982

[51] Int. Cl.[3] ..... E06B 3/32

[52] U.S. Cl. ..... 49/463; 49/57; 182/113; 292/228

[58] Field of Search ..... 49/463, 57, 124; 292/259, 262, 341.17, 341.14, 213, 238, 54, 228; 256/DIG. 6, 54; 182/113

[56] References Cited

U.S. PATENT DOCUMENTS

| | | | |
|---|---|---|---|
| 23,140 | 3/1859 | Stewart . | |
| 134,877 | 1/1873 | Finley . | |
| 395,500 | 1/1889 | McMullen . | |
| 498,108 | 5/1893 | Estep . | |
| 714,954 | 12/1902 | Setbacken | 292/54 |
| 731,199 | 6/1903 | Merker | 292/341.17 X |
| 984,711 | 2/1911 | Stanley . | |
| 1,012,256 | 12/1911 | Imig . | |
| 1,148,012 | 7/1915 | Elliott | 49/57 |
| 1,326,677 | 12/1919 | Lunken | 49/57 |
| 1,346,094 | 7/1920 | Josler | 49/57 |
| 2,295,995 | 9/1942 | Lamb . | |
| 2,303,718 | 12/1942 | Becker et al. | 49/57 |
| 3,224,048 | 12/1965 | Sullivan | 49/57 |
| 3,433,518 | 3/1969 | Foltz . | |
| 3,733,054 | 5/1974 | Storch . | |
| 3,853,203 | 12/1974 | Werner et al. | 182/113 |
| 3,952,453 | 4/1976 | Amburgey | 49/34 |
| 4,067,598 | 1/1978 | Mansour | 292/259 R |

*Primary Examiner*—Philip C. Kannan

[57] ABSTRACT

A removable safety barricade, comprising a cross piece supported by a retaining cup and a latch and able to withstand large forces. The latch supports the cross piece in a U-shaped, lower support area, the cross piece not normally being in contact with the upper release mechanism. The invention further provides for a one way gate opening only inwardly of the latch to close off the support area and confine the gate within the latch, the gate hanging at an angle with respect to the top of the latch when closed so that its own weight automatically closes the gate and resists accidental opening. The gate can have an extending tab to provide for easy opening, and the invention further provides for a spacer plate disposed within the support area of the latch to prevent the cross piece from accidentally striking open the gate.

16 Claims, 7 Drawing Figures

REMOVABLE BARRIER ASSEMBLY

BACKGROUND OF THE INVENTION

Many work areas have platforms, stairwells, loading docks and other areas which must be open to allow for the passage of people and materials, yet which pose a substantial hazard of a worker accidentally falling from this elevated area due to the lack of a barrier at that particular point. To prevent these accidents, removable safety barricades are used to block off such an area or passage when it is not in use and which can be removed when the area has to be opened. In fact, the federal government has issued strict requirements for such removable barricades.

Since these removable barricades are subject to the possibility of being struck in many different directions and frequently by heavy falling or rolling objects they must be able to withstand a substantial force from all directions without being accidentally opened. Various such removable barricades are in use, but with those prior art barricades which are complicated to operate, workers will not replace the barricade after it has been removed for use of the passageway. There is also a need for a removable safety barricade in which the locking mechanism of the barricade cannot be accidentally disengaged and thereby present the hazard of the barricade appearing to be secured but giving away when it is leaned against or other pressure is applied to it. Additionally, there is a need for a removable safety barricade in which the locking mechanism is so constructed that forces and strains normally placed upon the barricade will not adversely affect the locking mechanism and cause accidental failure.

SUMMARY OF THE INVENTION

The present invention is drawn to a removable safety barricade of the type comprising one or more metal cross pieces supported between two supports. More specifically these supports have brackets firmly affixed to either side of the passageway defined between the supports, which passageway is to be blocked by the cross piece or pieces. One bracket for each cross piece is a rectangular metal box constituting a retainer piece having one end open to receive an end of the cross piece. The other bracket for each cross piece is a latch which has means for supporting and restraining the cross piece and means for locking and releasing the cross piece.

The retainer piece provides a socket having a cross-section dimension slightly larger than the cross-section of one end of the cross piece, so that such end can be slid into the socket of the retainer piece and still be allowed a slight bit of lateral movement. This lateral movement allows the opposite end of the cross piece a limited amount of horizontal and vertical movement so that it can be moved into a position for being latched into the safety latch. The safety latch has an inside area defined by a top, back and bottom wall, the top and bottom walls being spaced a distance at least twice the height of the end of the cross piece to be received therein. A lip extends upward from the bottom wall at least as high as one side of the cross piece, yet leaving a gap between the top of the lip and the top wall larger than the height of the end of cross piece.

A one way gate is attached to the top wall with a hinge, allowing the gate to hang down from the top wall and close the gap between the lip and the top wall.

This gate is the locking mechanism which swings up and inwardly open when an end of the cross piece is pressed against the outside of the gate, allowing the cross piece to pass through the exposed opening and then be lowered into the U-shaped support area formed by the back wall, bottom wall and lip. The weight of the gate causes the gate to swing down and close, the end of the gate abutting the top of the lip, thereby confining the end of the cross piece within the latch.

To remove the barricade the latch gate is lifted up exposing the gap between the lip and top wall, thereby allowing the cross piece to be lifted up and slid forwardly through the gap, after which the other end of the cross piece is slid out of the socket of the retainer cup.

In other aspects of the invention, the latch gate has an extension or tab which protrudes past the hinge so as to be exposed, thus allowing the gate to be opened by simply depressing this tab to pivot the gate. Also, the top wall of the safety latch extends further forward than the bottom wall so that the gate hangs down at an angle with respect to the lip creating a greater tendency for the gate to remain closed and thus minimizing the accidental opening of the latch.

Due to this safety barricade's simple design, it is easy to operate and therefore less likely to be left open. To close only requires that one end of the cross piece be fitted into the retaining cup and the other end of the cross piece be slid through the gap between the lip and top wall and then dropped down into the supporting area of the latch. To open the gate the tab is depressed, the cross piece end lifted and slid out through the gate area, and the cross piece removed from the retaining cup.

Since the weight of the gate automatically maintains the latch in a closed position, the latch cannot be accidentally left open and allow the cross piece to be knocked open when struck.

Also, the invention employs a cross piece that does not normally abut the release or gate mechanism. The end of the cross piece in the latch is supported by the U-shaped area formed by the back wall, bottom wall and lip. These are stationary walls which cannot be accidentally knocked open, such as would be the case if the cross piece were supported or positioned by the locking element of the latch. This reduces the wear on the locking mechanism and the possibility of the barricade opening due to failure of the locking mechanism.

These and other advantages of this invention will become obvious from a more detailed explanation of my invention made in conjunction with the appended drawings wherein:

DETAILED DESCRIPTION OF THE PREFERRED EMBODIMENT

Figure 1:
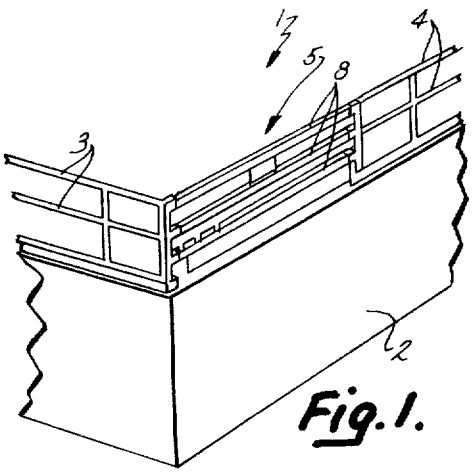
FIG. 1 is a perspective view illustrating one use of the safety barricade of this invention.

Referring to the drawings, FIG. 1 illustrates one use of the present invention. In this use the barrier assembly serves as a safety barrier to prevent persons from falling off from the mezzanine 2. It includes a plurality of stationary rails 3 mounted on one side of a mezzanine 2 and another plurality of stationary rails 4 mounted on another side of the mezzanine 2. Quite frequently such barrier assemblies require a part of the barrier to be removed in order to provide access to the mezzanine for many different reasons such as loading cargo from trucks and the like. Therefore, a removable barrier assembly 5 which constitutes a portion of the overall barrier assembly 1 is provided between the rails 3 and 4.

In many prior removable barrier assemblies, the movability thereof has rendered them a hazzard because although appearing to be secure, they can accidently be dislodged or are not sufficiently strong to sustain any loads which might be exerted on them. Consequently, the removable barrier assemblies of this type have experienced failures resulting in substantial injuries. As will be explained hereinafter, the barrier assembly 5 of the present invention is not only easily removable but also rigid, strong and secure and cannot be accidently dislodged.

Figure 2:
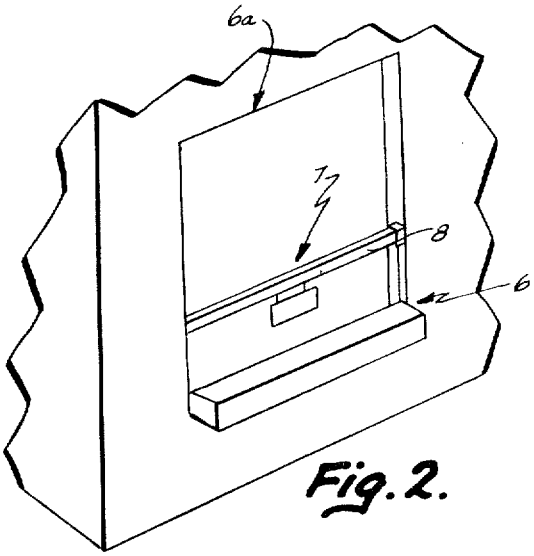
FIG. 2 is a perspective view illustrating a second use of the safety barricade of this invention.

FIG. 2 illustrates another use of the present invention with reference to a shipping dock. Reference numeral 6a designates an opening to the shipping dock 6 which is elevated for receiving cargo from trucks and the like. In this case, as will be noted, the barrier assembly 7 is a single rail rather than a plurality of rails as disclosed in FIG. 1. Thus, it should be understood that the only difference between movable barrier assemblies 5 and 7 is that assembly 5 comprises three removable barrier subassemblies 8 while the shipping dock modification of FIG. 2 includes only one such subassembly. Reference is now made to FIGS. 3–7 which discloses such a subassembly 8 in greater detail.

Figure 3:
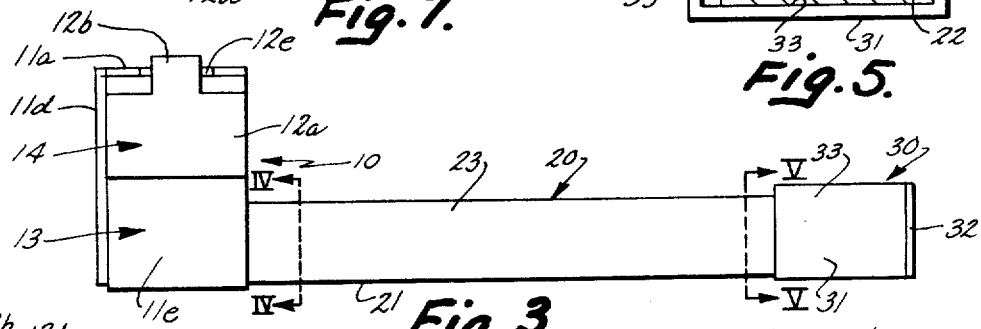
FIG. 3 is a front elevational view of the barrier subassembly of FIG. 2 embodying the present invention.

In FIG. 3 reference numeral 20 designates a cross piece or rail 20 supported at one end by a retainer cup 30, and at the opposite end by a latch 10. The latch 10 has a stationary support area or element 11, which supports and confines one end of cross piece 20. It also includes a release element 12 which permits entry of cross piece 20 into area 11 and can be opened to allow removal of the cross piece 20. Release element 12 is normally closed to confine the end of the cross piece 20 within the latch 10.

The cross piece or cross rail 20 is preferrably a rectangular or square hollow rail 21, made of heavy gauge steel to withstand a large force by standard metal forming techniques. The cross piece 20 has a longitudinal axis, four sides 22 each with an outer face 23, and is long enough to span the particular area or passageway that is required to be barricaded.

The retainer cup 30 is a short section of hollow rectangular stock having four sides 31 and an end 32. Each side 31 of the retainer cup 30 has an inner dimension 33 higher than the outer dimension 23 of sides 22 of cross piece 20. This allows a slight gap between the sides 22 of the cross bar 20 and the sides 31 of the retainer cup 30, so that the cross piece or rail 20 is allowed a small amount of lateral movement (perpendicular to the longitudinal axis of the cross piece, i.e., side to side, or up and down) within the retainer cup. This permits an adjustment of the opposite end of the rail 20 so that it can be moved and adjusted to fit into the safety latch 10. The retainer cup end 32 is welded to sides 31, and can be used to spot weld or bolt the retainer cup 30 to a railing, support post or wall.

Figure 4:
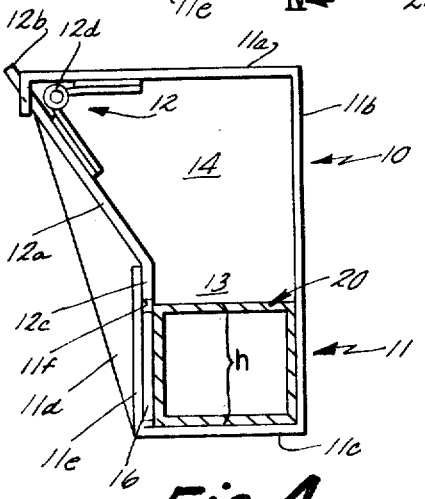
FIG. 4 is a cross-sectional view taken through the plane IV—IV of FIG. 3 showing the latch in a closed position.

The safety latch 10 includes a stationary support element or housing 11 comprising a lower portion 13 and an upper portion 14. The lower portion 13, as disclosed in FIG. 4, is U-shaped so as to substantially conform to the shape and size of the end of the rail piece 21. Thus, the rail piece 21 is seated in the U-shaped portion 13 when assembled.

The upper portion 14 of the housing 11 extends above the lower portion 13 a distance at least as great as the height of the rail 21 and preferably a greater distance so that the upper portion can receive the rail before it is dropped into position within the lower portion 13. The upper portion 14 has an opening or gap 15 for receiving the rail 21 above the lower portion 13. This opening 15 is selectively closed or opened by the one way gate 12a pivotally mounted at the top edge of the opening as will be described in greater detail hereinafter.

Figure 7:
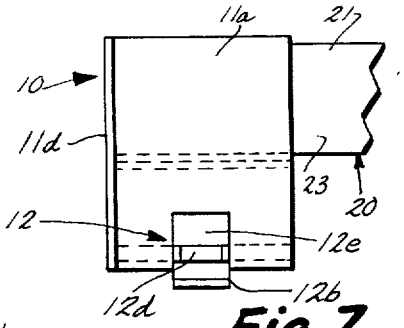
FIG. 7 is a top plan view of a latch and a portion of a cross piece embodying the invention.
Figure 5:
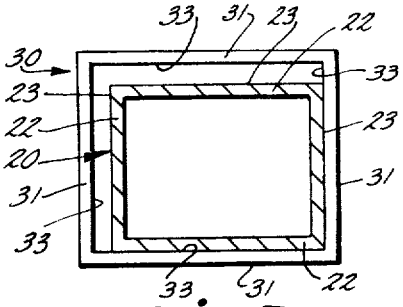
FIG. 5 is a cross-sectional taken through the plane V—V of FIG. 3 showing the retaining cup of the present invention.
Figure 6:
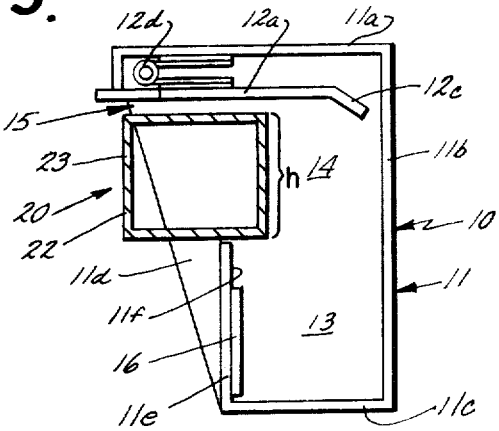
FIG. 6 is a cross-sectional view similar to FIG. 4 but showing the latch in an open position.

More specifically, referring to FIGS. 4, 6 and 7, the housing 11 of latch 10 is shown as having a top wall 11a, back wall 11b, bottom wall 11c, lip 11e and a side wall 11d. Top wall 11a and bottom wall 11c are spaced a distance at least twice the height of side 22 of rail 20. Lip 11e extends upward from the bottom wall 11c a distance greater than the height "h" of the cross bar 20 but less than the height of back wall 11b, leaving a gap 15 between the lip 11e and top wall 11a. Gap 15 is sufficient to allow the end of the cross piece 20 to pass between the lip 11e and the top wall 11a into the upper portion 14 of housing 11. Top wall 11a extends forward from back wall 11b a greater distance than bottom wall 11c which extends forward from back wall 11b only a sufficient distance to accommodate cross piece 20 between back wall 11b and lip 11e. The back wall 11b, bottom wall 11c and lip 11e form the generally U-shaped lower portion 12. End wall 11d is attached to top wall 11a, side wall 11b, bottom wall 11c, and lip 11e, allowing the latch 10 to be spot-welded or bolted to a railing, support post, or wall.

The release element or locking mechanism 12 is made up of gate 12a attached to the front of top wall 11a by hinge 12d welded to gate 12a and top wall 11a. Gate 12a hangs down from top wall 11a with the bottom edge 12c thereof resting against lip 11e. Gate 12a is a one way gate in that it can only be opened by pivoting inwardly of housing 11 since lip 11e stops gate 12a from pivoting outwardly to an open position. Since top wall 11a extends further forward from back wall 11b than bottom wall 11c, when gate 12a hangs down in a closed position it is oriented at an angle to lip 11e. Bottom edge 12c of gate 12a is bent at a slight angle with respect to gate 11a, so that the bottom edge 12c abuts against lip 11e. A tab or extension 12b extends upwardly through notch 12e cut in top wall 11a, tab 12b being used to open gate 12a. A spacer plate 16 at least as thick as the thickness of gate 12a is welded to inner face 11f of lip 11e. This spacer plate 16 positions cross piece 20 inwardly of lip 11e so that if cross piece 20 is knocked upwards it cannot strike bottom edge 12c of gate 12a and accidentally open latch 10.

OPERATION

With the above description and drawings, the operation of the safety barrier can be readily understood. Retaining cup 30 is affixed to the railing, support post or wall on one side of the passageway to be blocked, and latch 10 is affixed to the railing, post or wall on the other side of the passage. For example FIGS. 1 and 2.

To block the passageway, one end of cross piece 20 is slid parallel to its longitudinal axis into retainer cup 30 and thus supported in that position. Because the inner area of retainer cup 30 is larger than the outer area of cross bar 20 the other end of the cross piece 20 can be manuevered to press against gate 12*a* of latch 10 and passed through gap 15, then be lowered into U-shaped support area 13. Once the cross-rail 20 is in place the weight of the gate 12*a* will automatically drop gate 12*a*, closing off gap 15 and thereby confine the end of cross piece 20 within latch 10.

Because top wall 11*a* extends further from back wall 11*b* than bottom wall 11*c*, gate 12*a* is positioned at an angle with respect to lip 11*e* instead of being parallel to lip 11*e*, thereby reducing the chance the gate will flap open accidentally. Since cross piece 20 is contained within support area 13 of the safety latch 10, it is supported by stationary members instead of being positioned by locking mechanism 12, reducing the chance that cross piece 20 will accidentally open if locking mechanism 12 fails.

To open the safety barricade, gate tab 12*b* is depressed and the end of cross piece 20 that is in latch 10 is simply raised and passed through gap 15. Cross piece 20 is then slid out of retaining cup 30.

Since the retaining cup 30 and latch 10 are formed from steel plate joined by welding, the safety barricade can be constructed to withstand extremely large forces from any direction, yet remains simple to use.

Of course, it is understood that the above is merely a preferred embodiment of the invention and that various changes and alterations can be made without departing from the spirit and broader aspects thereof as more particularly defined in the appended claims, such as a different cross piece or retainer cup configuration, the addition of a mechanical activating device to the gate, or replacing the various walls of the safety latch with a single smoothly curved plate.

The embodiments of the invention in which an exclusive property or priviledge is claimed are defined as follows.

1. A removable safety barrier, comprising:

a barrier rail means for preventing passage through a given area bounded by a first and second support means, said rail means being elongated and having a first and second end;

a retaining means for releasably supporting said first end of said barrier rail means and limiting the movement thereof;

a latching means for removably supporting said second end of said barrier rail means, said latching means having a releasing means allowing said second end of said barrier rail means normally to be restrained by said latching means, said latching means also including release means for releasing said barrier rail means when said release means is activated, and said latching means also having a stationary support element;

said barrier means normally being positioned and supported by said stationary support element and not in contact with or supported by said releasing means;

said stationary support element comprises a back wall, a bottom wall and a lip;

said back wall and said lip extending upward from said bottom wall to define a U-shaped support area;

said releasing element comprises a top wall extending outward from said back wall and a gate pivotally connected to said top wall;

said lip extending upward from said bottom wall a distance less than said back wall extends from said bottom wall, thereby defining a gap between said lip and said top wall;

said gate spanning said gap between said lip and said top wall so that said gate abuts said lip when said gate is in a closed position;

said gate pivotally opening only inwardly of said release element;

such that said barrier means may be passed through said gap between said lip and said top wall, supported in said support area and then confined within said safety latch by said gate, whereby said retaining means and said latching means will support said barrier rail means when subjected to a force from any direction.

2. A barrier as described in claim 1, wherein:

said gate is biased into a closed position by the weight of said gate;

said gate having a tab, said gate being opened when said tab is depressed.

3. A barrier as described in claim 2, wherein:

said top wall extends further from said back wall than said bottom wall extends from said back wall;

said gate is pivotally connected to said top wall at a point further removed from said back wall than said bottom wall extends from said back wall, such that said gate when in a closed position is oriented at an angle with respect to said lip.

4. The barrier as described in claim 1, 2, or 3 wherein:

a spacer means for positioning said barrier means in said stationary support element, said spacer means being disposed within said stationary support element adjacent said lip and generally beneath the location of the portion of said gate that is in abutment with said lip when in a closed position, and said spacer means having a thickness at least as thick as the thickness of said gate to prevent said barrier means from accidentally striking and opening said gate.

5. A removable safety barrier, comprising:

a rigid cross bar having a height and a longitudinal axis;

a retainer cup, having an aperture therein for slidably receiving and supporting a first end of said cross bar longitudinally and thereby restricting the movement of said cross bar, which can be affixed to one side of the passageway to be blocked;

a latch, supporting a second end of said cross bar opposite said first end, which can be affixed to the other side of the passageway to be blocked;

said latch having a stationary support element such that said cross bar is normally restrained from moving by said stationary support element, and a release element means for automatically opening and permitting free passage of said second end into said stationary support element and for automatic closing and locking to confine said second end within said stationary support element, said cross bar not normally in contact with said release element means, said release element means when positively engaged allowing for the release of said barrier and when not positively engaged confining said second end within said stationary support element;

such that said removable safety barrier can withstand a force from any direction.

6. A barrier as described in claim 5, wherein:

said stationary support element comprises a back wall, a bottom wall and a lip, said back wall and said lip extending up from said bottom wall to define a U-shaped support area.

7. A barrier as described in claim 6, wherein:

said release element means is comprised of a top wall extending out from said back wall and a one way gate pivotally connected to said top wall;

said lip not extending upward from said bottom wall as far as said back wall extends, but said lip extending up from said bottom wall a distance greater than said height of said cross piece;

said back wall extending up from said bottom wall a distance to define a gap between said lip and said top wall, said gap large enough to allow said second end of said cross piece to be passed through said gap;

said one way gate spanning said gap between said top wall and said lip, such that said one way gate abuts said lip when in a closed position, said one way gate opening pivotally only inwardly of said latch.

8. A barrier as described in claim 7, wherein:

the weight of said one way gate biases said one way gate into a closed position;

a tab extends from the end of said one way gate past said hinge, so that said one way gate pivotally opens when said tab is depressed.

9. A barrier as described in claim 8, wherein:

said top wall extends out from said back wall further than said bottom wall extends from said back wall, said gate being pivotally connected to said top wall at a point disposed further from said back wall than said bottom wall extends from said back wall;

such that when in a closed position said gate is oriented at an angle with respect to said lip.

10. A barrier as described in claim 9, further comprising:

a filler means for positioning said cross bar in said stationary support element adjacent said lip and generally beneath the location of the portion of said gate that is in abutment with said lip when in a closed position, said filler means having a thickness at least as thick as the thickness of said gate.

11. A barrier as described in claim 10, wherein:

the end of said one way gate which abuts said lip is bent at an angle with respect to said one way gate such that when said one way gate is in a closed position said end of said gate is parallel to said lip.

12. In a device including at least one elongated member supported by two support means spaced from each other a distance substantially equal to the length of said member;

a socket supported by one of said support means; said socket receiving one end of said member so as to encompass the same and to prevent removal therefrom except by longitudinal movement of said member in a direction out of said socket;

a retainer latch means supported by the other of said support means, said latch means including:

a housing having a lower portion and an upper portion, said lower portion being adapted to receive and support said end of said member, said upper portion being shaped and dimensioned to receive said member and extending upwardly from and communicating with said lower portion permitting said member to pass from said upper portion of said housing to said lower portion and vice versa;

an opening in said upper portion, said opening being sufficiently large to permit passage of said member therethrough into said upper portion;

a one way gate pivotally mounted on said housing upper portion adjacent said opening and pivotal from closed to open position only inwardly of said housing, said one way gate pivotally mounted to pivot into said upper portion, said gate adapted to close said opening and prevent removal of said member therefrom but permitting said member to enter said upper portion through said opening and pass to said lower portion with said gate positioned generally above said lower portion;

means for urging said gate to closed position over said opening to prevent accidentally removal of said member from said housing by forces from any direction;

and means for selectively opening said gate and permit removal of said member from said housing, whereby said member will pass through said upper portion and into said lower portion out of contact with said gate, but when said member is raised into said upper portion while said one way gate is in said closed position said member blocks said gate from pivoting into an open position.

13. In a latch device for an elongated member for releasably supporting one end of said elongated member comprising:

a housing having a lower portion end and an upper portion, said lower portion being adapted to receive and support said end of said member, said upper portion being shaped and dimensioned to receive said member and extending upwardly from and communicating with said lower portion permitting said member to pass from said upper portion of said housing to said lower portion and vice versa;

an opening in said upper portion, said opening being sufficiently large to permit passage of said member therethrough into said upper portion;

a one way gate pivotally mounted on said housing upper portion adjacent said opening and pivotal from closed to opened position only inwardly of said housing, said one way gate pivotally mounted to pivot into said upper portion, said gate adapted to close said opening and prevent removal of said member therefrom but permitting said member to enter said upper portion through said opening and pass into said lower portion with said gate positioned generally above said lower portion;

means for urging said gate to closed position over said opening to prevent accidental removal of said member from said housing by forces from any direction;

and means for selectively opening said gate and permit removal of said member from said housing, whereby said member will pass through said upper portion and into said lower portion out of contact with said gate, but when said member is raised into said upper portion while said one way gate is in said closed position said member blocks said gate from pivoting into an open position.

14. In the devices as described in claim 12 or 13, wherein:

said housing has a top, back and bottom, said top extending further from said back than said bottom extends;

said one way gate being pivotally mounted on said top at a point disposed further from said back than said bottom extends, such that the weight of said one way gate biases said gate into a closed position, and when in a closed position said gate forms an angle of less than 90 degrees with said top.

15. In the devices as described in claim 14, wherein:

said lower portion is comprised of said back and said bottom and a lip extending up from said bottom, said lip extending upward at least the height of an end of said member to be supported;

said back extending up from said bottom farther than said lip extends to define said opening in said upper portion;

said gate when in a closed position abutting said lip.

16. In the devices as described in claim 15, further comprising:

a spacer means for positioning the end of the rail to be received within said lower portion adjacent said lip and generally beneath the location of the portion of said gate that is in abutment with said lip when in a closed position, said spacer means having a thickness at least as thick as the thickness of said gate to prevent said member from accidentally striking and opening said gate.

* * * * *